United States Patent [19]

Rushing

[11] Patent Number: 5,046,625

[45] Date of Patent: Sep. 10, 1991

[54] MODULAR DISPLAY STAND FOR PERSONAL CARE APPLIANCES AND THE LIKE

[75] Inventor: Thomas Rushing, Denville, N.J.

[73] Assignee: Conair Corporation, Stamford, Conn.

[21] Appl. No.: 575,170

[22] Filed: Aug. 30, 1990

[51] Int. Cl.[5] ..... A47F 7/00

[52] U.S. Cl. ..... 211/70.6; 211/13; 248/176; 248/309.1

[58] Field of Search ..... 211/70.6, 86, 13; 248/176, 309.1, 316.8, 116, 117.2

[56] References Cited

U.S. PATENT DOCUMENTS

| | | | |
|---|---|---|---|
| 3,179,255 | 4/1965 | De'Caccia | 211/70.6 |
| 3,627,248 | 12/1971 | Nelson | 248/309.1 |
| 4,275,862 | 6/1981 | Takagi et al. | 248/316.8 X |
| 4,730,799 | 3/1988 | Foss et al. | 211/70.6 X |
| 4,821,889 | 4/1989 | Cohen | 211/13 |

*Primary Examiner*—Robert W. Gibson, Jr.
*Attorney, Agent, or Firm*—Haynes N. Johnson

[57] ABSTRACT

A display stand for displaying appliances, allowing for change of the appliance displayed and of associated promotional cards, having an upper face plate made of transparent material and supported at an angle away from vertical, display card guides on the under side of the upper face plate, an appliance holder, a horizontal slot in the upper face plate gripped by the appliance holder, a lower face plate mounted below the upper face plate, a line cord opening between the lower face plate and the upper face plate, and a wire lock clip dimensioned to fit over the opening and to receive and secure a line cord from a displayed appliance.

10 Claims, 5 Drawing Sheets

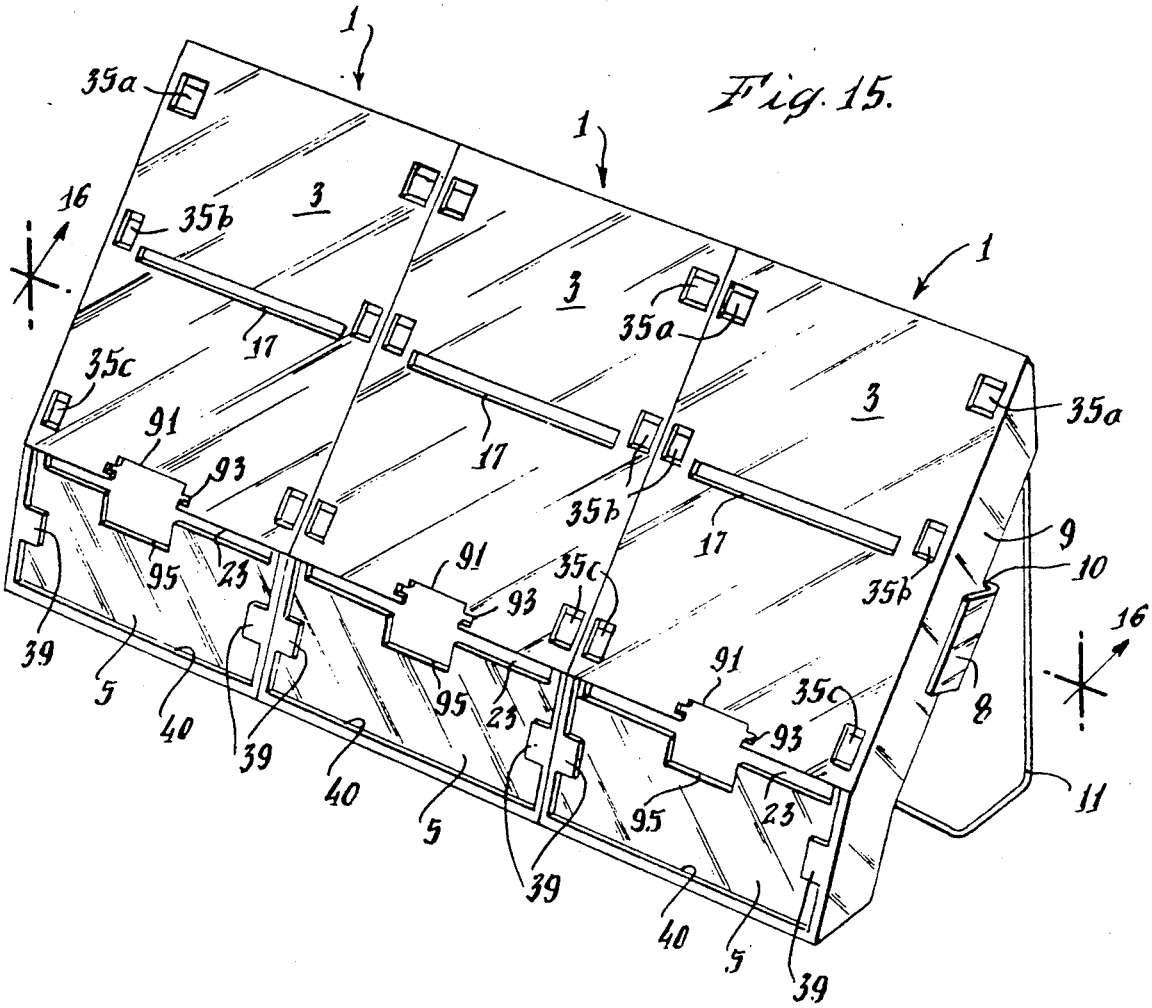
Fig. 15.
Fig. 16.
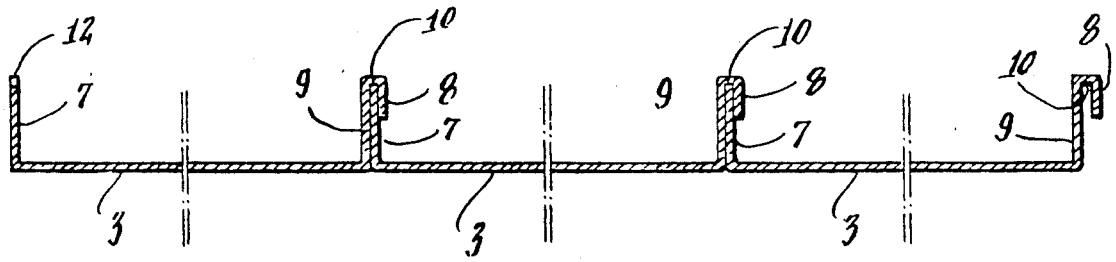

MODULAR DISPLAY STAND FOR PERSONAL CARE APPLIANCES AND THE LIKE

FIELD OF THE INVENTION

This invention relates to display stands of the type which sit on counters or shelves in retail stores. They are used, in particular, to display personal care appliances such as curling irons and hair dryers and can be readily changed to hold different appliances and to use different associated promotional cards. Such displays are best if they allow a customer to handle and examine the product, but, at the same time, make theft difficult.

BRIEF SUMMARY OF THE INVENTION

This display stand is for use in retail stores, on the counters or on shelves. The basic, modular unit can be interlocked in multiples on the counter, providing as many display sections as desired. Each unit itself is readily adaptable to holding and displaying different personal care appliances, such as hair dryers, curlers, and hot brushes; and the display can be easily altered.

The stand, which is made of colorless transparent plastic, has a large upper face angled backwardly and a smaller lower face below it. The faces are supported by legs formed of stiff wire. Connecting brackets on the sides of the unit allow two or more such units to be secured together.

Guides are provided on the back of the upper face to hold interchangeable promotional cards behind that face. Guides are provided on the front of the lower face to carry further promotional cards or pricing information. There is a full width slot between the upper and lower faces for insertion and removal of promotional cards behind the upper face.

The upper face has a horizontal slot which can receive and hold the upper ends of one or more holders used to display appliances. The holders can be designed and dimensioned to hold specific appliances.

An opening is formed in the lower end of the upper face and in the upper end of the lower face to receive electric cords from the appliances being displayed. A wire locking clip fits within that opening, holding the cords, thus preventing theft of the appliances.

DESCRIPTION OF THE DRAWINGS

FIG. 15 is a perspective view showing three stands secured to one another, creating a larger display. The stands are designed such that any number of stands may be secured together.

FIG. 16 is a section, taken on line 16—16 of FIG. 15, giving details of the interlocking of the three stands.

DETAILED DESCRIPTION OF THE INVENTION

Figure 2:
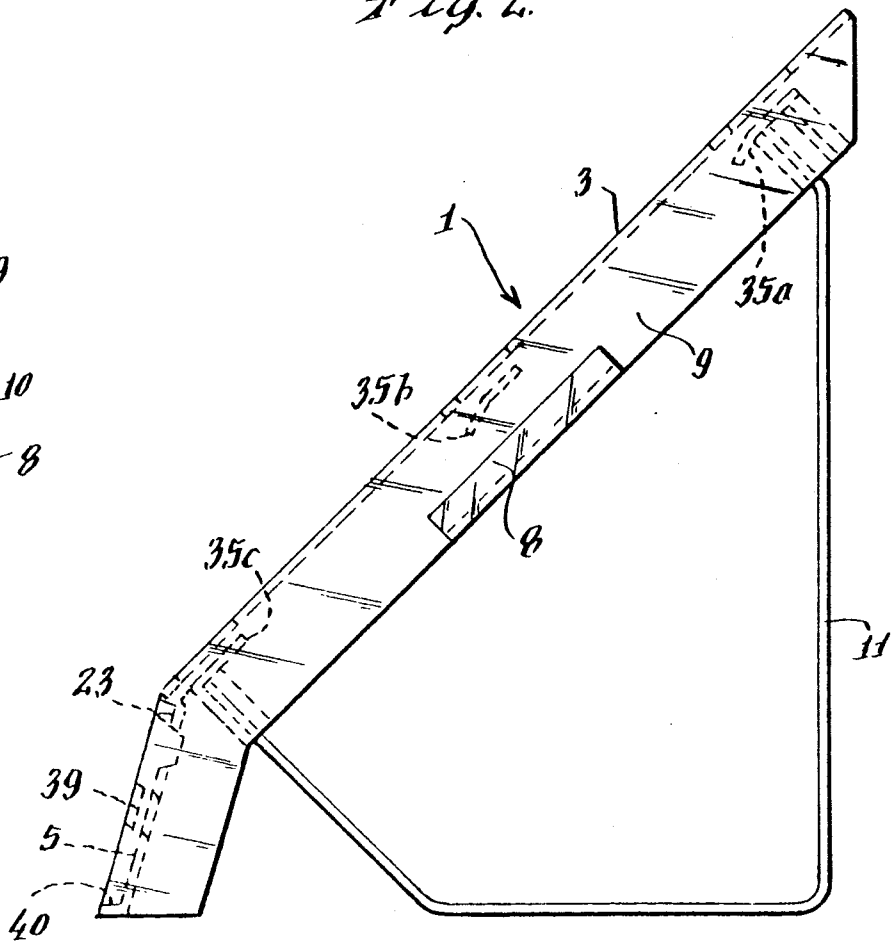
FIG. 2 is a right side elevation of the stand.
Figure 1:
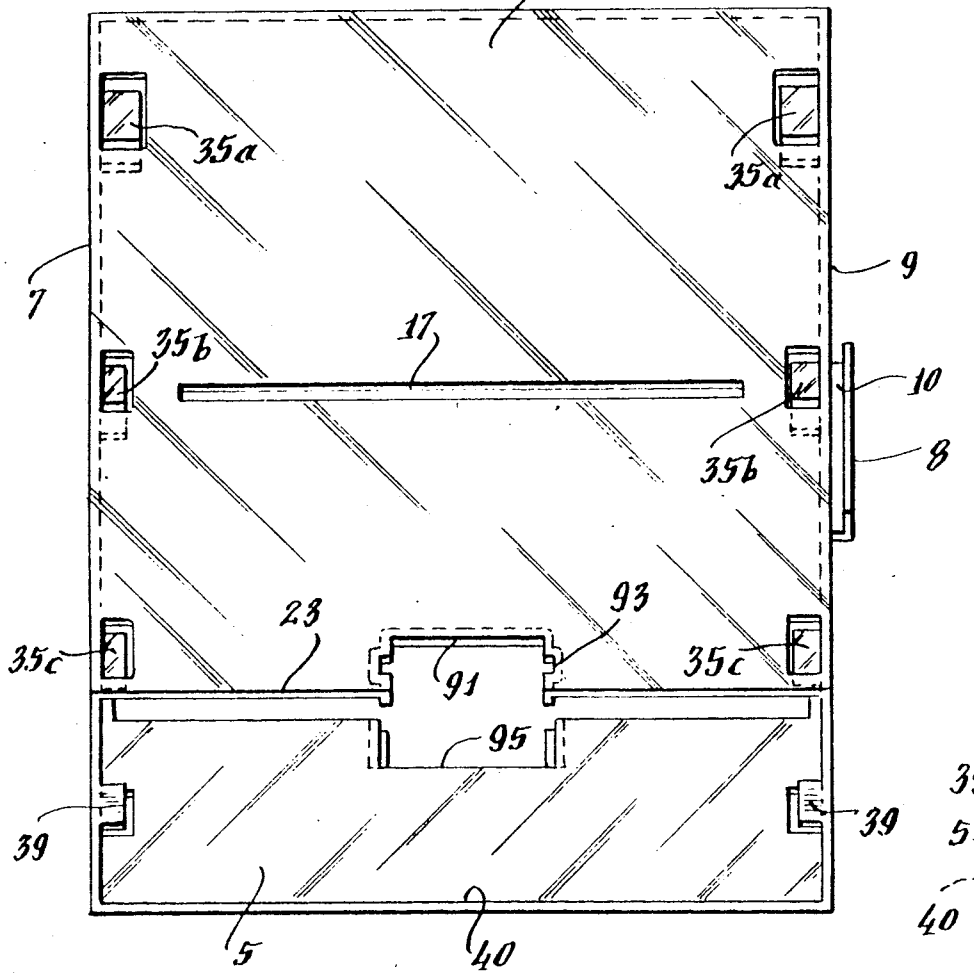
FIG. 1 is a front elevation of the display stand, not carrying any appliances.

This modular display stand 1 is preferably made of clear, colorless, transparent plastic, such as methyl methacrylate ester polymer, sold under the name Lucite. The various parts can be bonded together adhesively or bonded by using a solvent to fuse the joints together.

Stand 1 includes an upper face plate 5 at about a 45° angle from the vertical and a lower face plate 5 which can be vertical or incline backward slightly. It also includes left and right side members 7 and 9. A horizontal slot 17 extends across the middle of upper face 3 for most of its width and is used to secure appliance holders in place on the upper surface of upper face plate 3.

Two stiff wire supports 11 fit within upper receiving slots 13 and lower receiving slots 15, the slot members being secured to the back of upper face plate 3 and to their respective side members 7 and 9. One satisfactory dimension for the display stand is to have upper face plate 3 about 10 inches wide and about 12½ inches high, and lower face plate 5 about 10 inches wide and about 2¼ inches high.

Guides 35*a*, 35*b*, and 35*c* on each side of the back (under side) of upper face plate 3 serve to hold an upper promotional display card 31 and a backing board 33 in place. Display card 31 can then be seen through upper face plate 3. A slot 23 between upper face plate 3 and lower face plate 5 allows the display card 31 and backing board 33 to be inserted from the front between the back of upper face plate 3 and guides 35*a*, 35*b*, and 35*c*. Alternatively, they can be inserted and removed from the top.

Lower face plate 5 is slightly recessed between sides 7 and 9 and has guides 39 in front of it at the sides. There is also a stop member 40 at the bottom. This permits a lower card 37 to be positioned in front of lower face plate 5 to display, say, pricing information.

Figure 11:
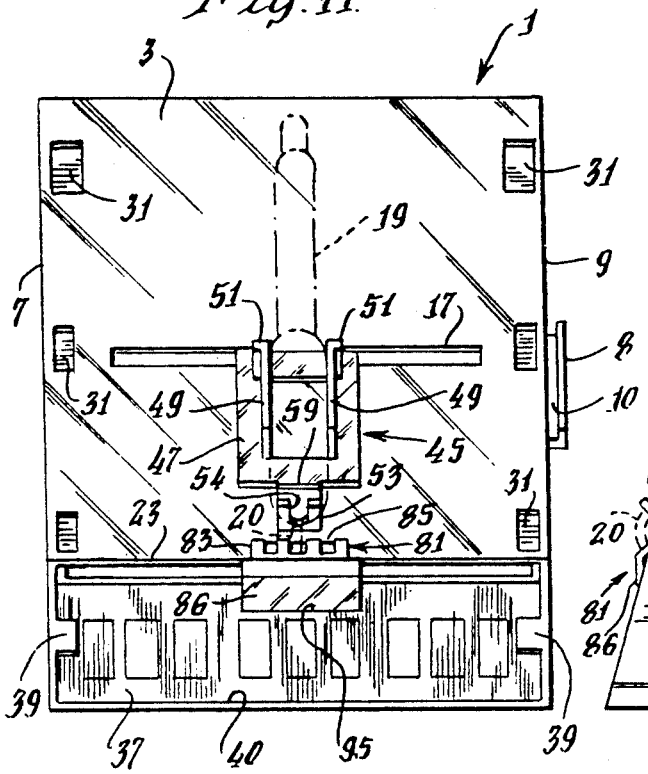
FIGS. 11 and 12 are front and right side elevations, respectively, showing the stand holding and displaying a curling iron. As can be seen, there is space on the stand to hold two additional curling irons, if desired.
Figure 12:
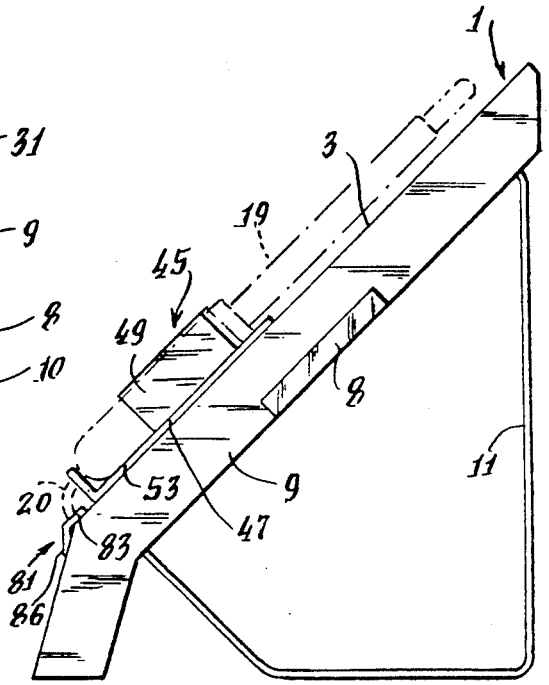

A curling iron holder 45 is made to fit in slot 17 in upper face plate 3, to hold and display a curling iron 19 or similar device (FIGS. 11 and 12). Holder 45 (FIG. 4) has a back 47 to which are adhered two supporting arms 47 with inwardly extending lips 51. It has a downward L-shaped extension 53 with a cord slot 54. The arms are so spaced as to hold the handle of a curling iron or other appliance in snap-fit engagement. The lower end of the handle rests upon extension 53 with the cord 20 passing through cord slot 54.

Figures 4, 5, 7, 8:
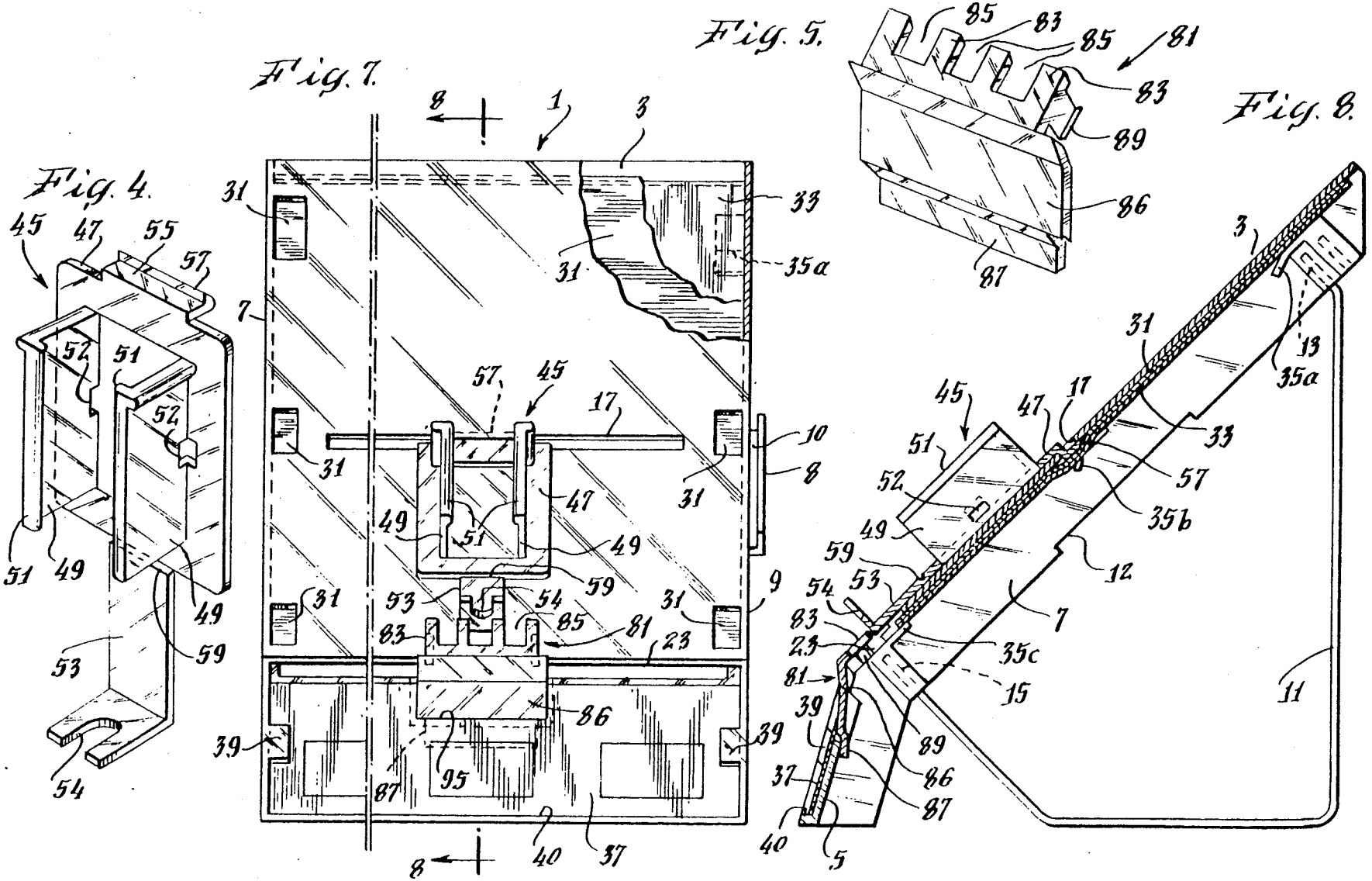
FIG. 4 is a perspective view of a holder for mounting on the upper face of the stand to hold appliances for display.
FIG. 5 is a perspective view of a locking clip to hold the line cords of the appliances.
FIG. 7 is a front elevation, similar to FIG. 1, showing an appliance holder and the locking clip in place.
FIG. 8 is a section, taken on line 8—8 of FIG. 7, again showing an appliance holder and the locking clip in place.

The upper end of back 47 carries a clamp 55, extending transversely backward from the upper edge of back 47. A locking lip 57 is on the lower edge of clamp 55, extending upwardly and parallel to back 47; its lower edge is bevelled. Clamp 55 and locking lip 57 are so shaped and dimensioned as to allow them to fit within slot 17 with lip 57 extending upwardly along the back of upper face 3 (FIGS. 7 and 8). This will secure holder 45 in place in the top surface of upper face plate 3.

After clamp 55 is positioned within slot 17, a curling iron can be snap-fitted within arms 49 for display. At the same time an appropriate display card 31 can be inserted behind upper face plate 3, and a second appropriate card 37 inserted in front of lower face 5. Holders 45 are about 2¼ inches wide, and slot 17 about 7½ inches long, so three holders, displaying three different appliances, could be used at one time.

Figure 14:
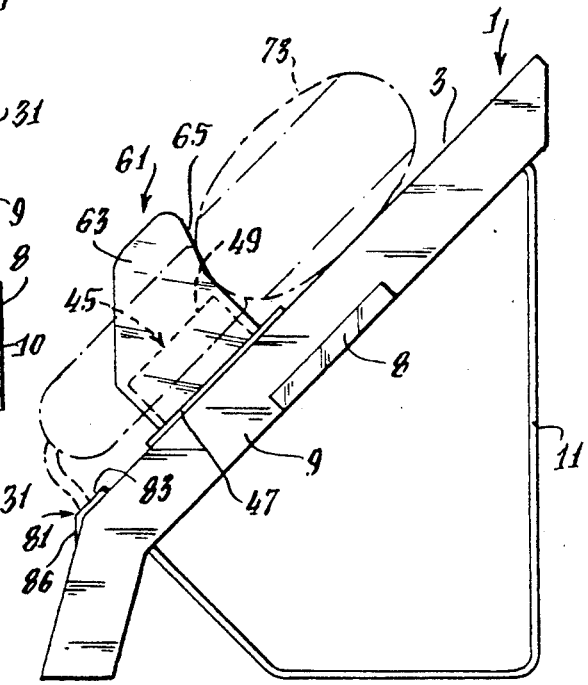

In order to display a larger appliance, such as a hair dryer, holder 45 could be enlarged in size. Alternatively, a supplemental holder 61 (FIG. 6) can be used. Rather than fitting into slot 17 itself, holder 61 fits on curling iron holder 45, which holds it in place. Extension 53 on holder 45 may include a cut 59 (FIGS. 8 and 11), enabling extension 53 to be broken off to avoid getting in the way of the handle of a dryer. Holder 61 has two parallel arms 63 with upper dryer support surfaces 65. Support surfaces 65 cant upwardly (FIGS. 9 and 14) so that they not only support a dryer 73, but also press it backwardly against upper face 3. The arms are spaced and held by top and bottom crosspieces 67, having curved forward surfaces 69 to receive the handle of a dryer.

Figure 13:
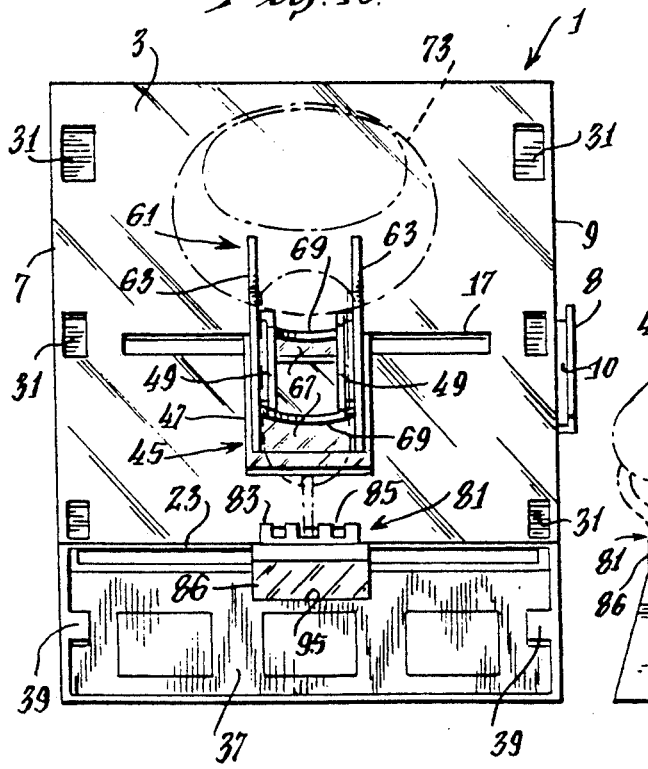
FIGS. 13 and 14 are front and right side elevations, respectively, showing the stand holding and displaying a hair dryer.

The arms 63 and crosspieces 67 are so spaced and dimensioned as to fit about the arms 49 of the curler holder 45, and the arms 63 are of such a length that the crosspieces 67 fit over the ends of arms 49. Thus, dryer holder 61 can be fitted about curling iron holder 45, with supporting surfaces 65 uppermost. A dryer 73 can then be displayed, as shown in FIGS. 13 an 14.

Figures 3, 6, 9, 10:
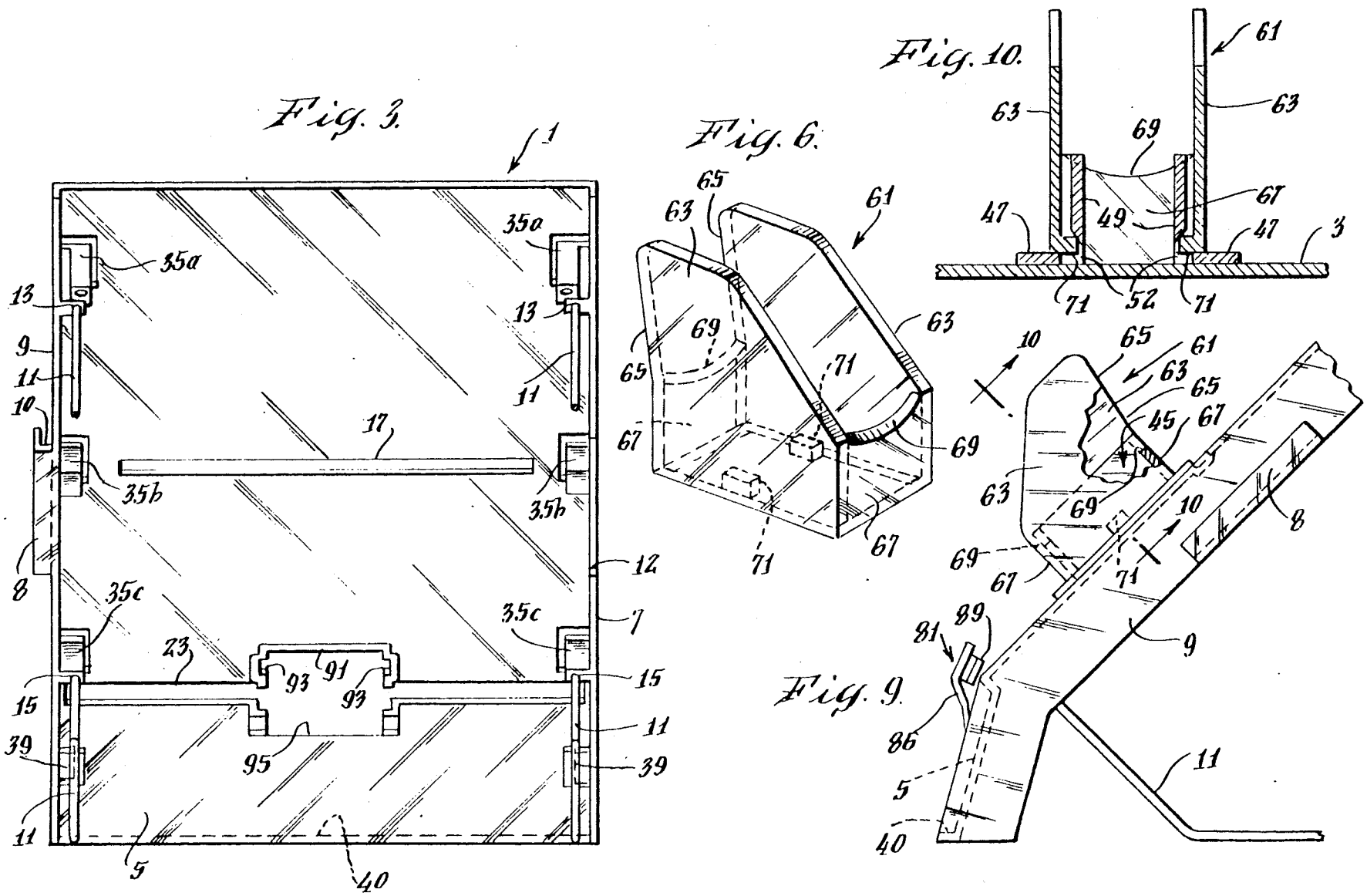
FIG. 3 is a rear elevation thereof.
FIG. 6 is a perspective view of supplemental appliance holder; this holder fits onto the first holder.
FIG. 9 is a right side elevation showing the appliance holder of FIG. 6 in place.
FIG. 10 is a section, taken on line 10—10 of FIG. 9.

It will be noted that holder 45 has two openings 52 in arms 49 where they meet the back 47. Dryer holder 61 has two corresponding latches 71 extending inwardly from the lower part of the arms 63. Thus, when dryer holder 61 is fitted about curling iron holder 45, latches 71 snap into openings 52, holding it in place (FIG. 10). The fit is not so tight, however, as to prevent the removal of holder 61 when it is not needed.

A wire lock clip 81 is shown in FIG. 5. It is used to carry the appliance electrical cords 20 to the back of the stand out of the way, or, alternatively, to a source of electricity so the appliances can actually be demonstrated. Clip 81 has three wire slots 85 in its locking face 83. These slots are big enough to permit passage of cord 20, but not of the plug on the end. Therefore, when wire lock clip 81 is secured in place, the appliances cannot be removed from the stand 1, and, so, are protected from theft.

Wire lock clip 81 has a main body portion 86, with locking face 83 extending upwardly from it and lower extension 87 extending downwardly and inwardly, Outwardly facing latches 89 extend inwardly on the sides of face 83.

A lower opening 91 on the bottom edge of upper face 3 and an upper opening 95 on the top of lower face 5 are dimensioned and shaped to complement and receive clip 8!. Lower extension 87 fits within opening 95 such that its lower extension 87 is behind lower face 5. Opening 91 is dimensioned such that outwardly-directed latches 89 will catch behind upper face plate 3. When in place, wire lock clip essentially covers openings 91 and 95. Small side openings 93 are located such that a small screwdriver can be inserted to press against latches 89 and release them.

Together openings 91 and 95 are large enough to allow the plug on a cord 20 to pass through. Therefore, in use, after a particular appliance is placed on its holder the plug and much of the cord 20 are passed through this opening, the cord is placed in one of slots 85, and wire lock clip 81 snapped into place in openings 91 and 95, being held in place by latches 89. Up to three cords 20 can be held by this clip. A customer will then be unable to steal the appliance because he cannot get the line cords free. When the display is to be changed, however, the clip 81 can be readily removed by using a small screwdriver in openings 93 to release the latches.

Since clip 81 also straddles horizontal slot 23, it is also useful in preventing the removal through that slot of upper display card 31 and backing board 33. Lower card 37, being in front of lower face 5, serves to cover much of clip 81.

FIGS. 15 and 16 show the use of multiple stands 1 joined together to form an integral unit. The right side 9 (right as one faces the stand) carries a spaced upstanding member 8 which serves to form a groove 10 between member 8 and right side 9. This groove is so positioned and spaced that it can receive and hold the lower edge of left side 7. Preferably, side 7 is notched (12 in FIG. 8) to receive member 8 and to hold it more securely. Thus, by so interlocking two or more stands, a multiple, integral unit is created.

To set up the display stand in the first instance, the wire supports 11 are installed; the upper display card 31 and its backing board 33 are mounted behind upper face 3; the appropriate holders 45 and 61 are attached to the upper face 3 through slot 17; the appliance is place in the holder; the line cord is run through openings 91 and 95; the wire lock clip is installed; and the lower pricing card is mounted. The display can later be changed as desired.

I claim:

1. A display stand for displaying appliances, said display stand including an upper face plate made of transparent material, supporting means for holding said upper face plate at an angle away from vertical, said upper face plate having display card guide means on the under side thereof, said upper face plate having a horizontal slot extending substantially the width thereof, a lower face plate mounted on said supporting means and below said upper face plate, the upper edge of said lower face plate and the lower edge of said upper face plate defining a line cord opening, at least one appliance holder having appliance holding arms, means to secure said appliance holder to said horizontal slot, and a wire lock clip dimensioned to fit over said opening, said wire lock clip having a line cord opening to receive a line cord from said appliance, and means to secure said wire lock clip over said opening.

2. A display stand as set forth in claim 1 in which said appliance holding arms have inwardly extending lips adapted to hold an appliance in snap-fit.

3. A display stand as set forth in claim 1 including a supplemental holder having upstanding holding arms and associated crosspieces and being dimensioned to fit about said appliance holder.

4. A display stand as set forth in claim 1 including complementary engagement members on opposite sides of said upper face plate whereby two or more said display stands may be fitted together to form a unitary structure.

5. A display stand capable of displaying various appliances, said display stand including an upper face plate made of transparent material, means for supporting said upper face plate at an angle away from the vertical, means on the under surface of said upper face plate for holding a display card against said undersurface so that said card can be viewed through said upper face plate, a horizontal slot running medially across said upper face plate, and an appliance holder secured to said slot, whereby an appliance can be held and displayed by said appliance holder.

6. A display stand as set forth in claim 5 in which said appliance holder includes a back, a pair of transverse supporting arms extending upwardly from said back, and a holding clamp bearing a locking lip extending from the upper end of said back, whereby said appliance holder may be secured to said slot by said locking lip.

7. A display stand as set forth in claim 6 including a supplemental appliance holder, said supplemental holder including a pair of supplemental arms, cross-pieces securing said supplemental arms together, all so dimensioned as to fit about said supporting arms, and latch means securing said supplemental holder to said appliance holder.

8. A display stand as set forth in claim 5 including a plurality of said appliance holders secured to said slot.

9. A display stand as set forth in claim 5 including a lower face plate and means for supporting said lower face plate below said upper face plate.

10. A display stand as set forth in claim 9 including an opening between said upper face plate and said lower face plate, a wire lock clip dimensioned to fit over said opening, said wire lock clip including at least one wire receiving opening, and means for securing said wire lock clip over said opening, whereby the wire line cord of a said appliance being displayed may held by said wire receiving opening.

* * * * *